United States Patent [19]

Atkinson

[11] 3,973,419

[45] Aug. 10, 1976

[54] COMBINATION LOCK CONSTRUCTION FOR LUGGAGE ZIPPER LOCKS, SHACKLE LOCKS AND THE LIKE

[75] Inventor: Wallace E. Atkinson, Petersburg, Va.

[73] Assignee: Long Manufacturing Co., Inc., Petersburg, Va.

[22] Filed: Oct. 31, 1975

[21] Appl. No.: 627,877

[52] U.S. Cl. ..... 70/68; 70/25; 70/312

[51] Int. Cl.[2] ..... E05B 67/38

[58] Field of Search ..... 70/68, 312, 25, 69–76

[56] References Cited

UNITED STATES PATENTS

| | | | |
|---|---|---|---|
| 2,233,661 | 3/1941 | Bugg | 70/68 |
| 2,310,627 | 2/1943 | Greene | 70/68 |
| 2,741,114 | 4/1956 | Poux | 70/68 |
| 3,597,945 | 8/1971 | Feinberg | 70/74 |
| 3,776,006 | 12/1973 | Atkinson | 70/74 |

*Primary Examiner*—Robert L. Wolfe
*Attorney, Agent, or Firm*—Mason, Fenwick & Lawrence

[57] ABSTRACT

A combination lock assembly for use as a zipper fastener lock or an exposed shackle padlock or similar applications, including a lock housing having therein plural dial wheel assemblies located in a first of plural parallel planes, a bolt plate located in another of said planes, and a fence plate located in another of said planes between the dial wheel assemblies and the bolt plate, the fence plate and bolt plate being movable in relatively perpendicular directions, and the fence plate and hub portions of the dial wheel assemblies having coactive shaped surfaces for controlling locking and unlocking movement of the fence plate for locking and unlocking the bolt plate.

16 Claims, 8 Drawing Figures

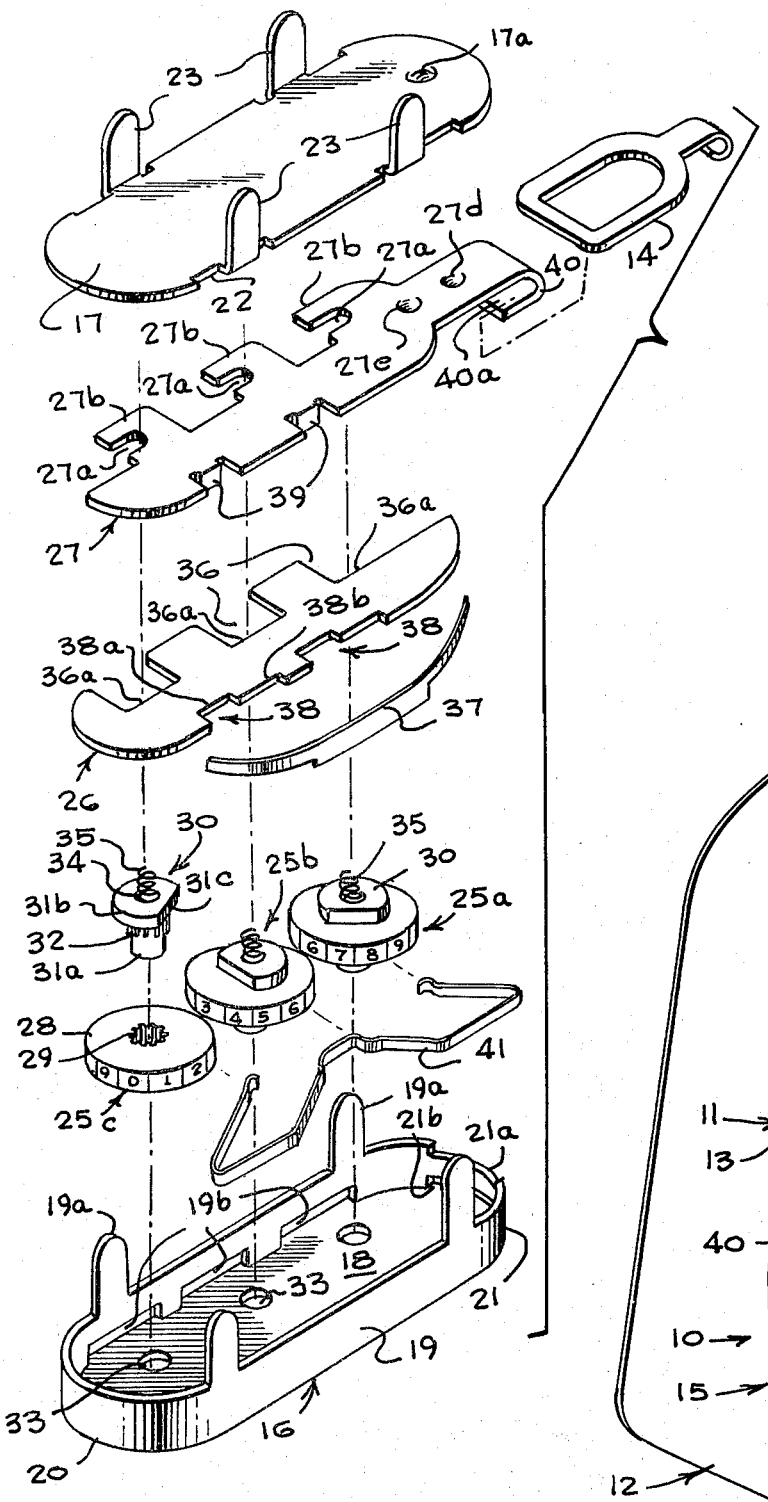
Fig-2
Fig-1
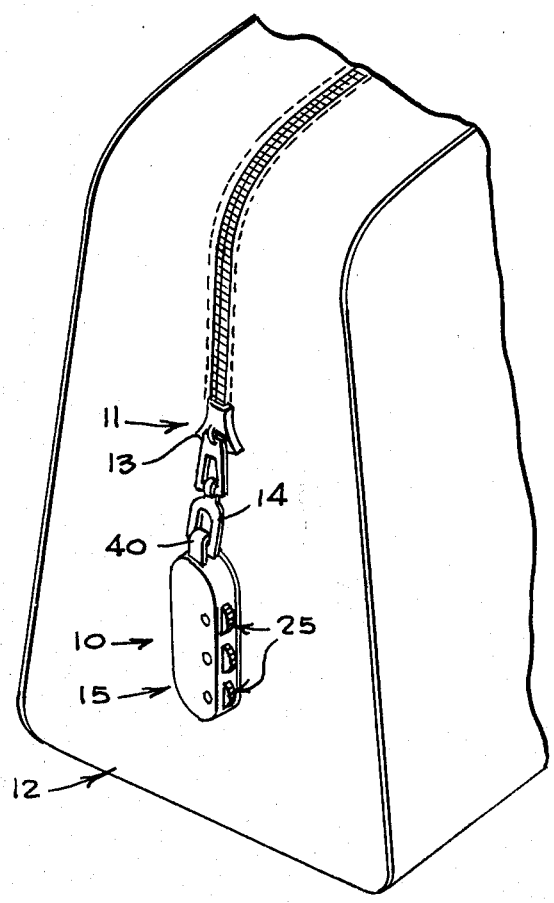

COMBINATION LOCK CONSTRUCTION FOR LUGGAGE ZIPPER LOCKS, SHACKLE LOCKS AND THE LIKE

BACKGROUND AND OBJECTS OF THE INVENTION

The present invention relates in general to combination lock structure particularly suitable for locking the zippers of luggage and the like and suitable for providing inexpensive and reliable combination shackle padlocks and similar applications, and more particularly to combination lock structure having a plurality of multiple combination dial members arranged along parallel axes of rotation to be set to combinations of dial numbers for releasing the lock, and having hubs with relieved portions positionable when the proper combination is dialed to accommodate movement of a fence plate relative to a bolt member in a direction transverse to the direction of bolt movement necessary to release the bolt member to permit unlocking movement of the bolt member. The bolt member may have an end formation adapting it to couple about a loop hinged on a zipper slide member or the bolt may be coupled to a leg of a lock shackle. In either application, movement of the bolt to extended position relative to the lock housing to release it from the zipper slide loop or to achieve movement of the shackle to unlocking position is permitted when the fence plate is shifted to release position relative to the dial assemblies.

While combination locks have been used for many years in a wide variety of locking applications, such combination locks for the most part have been of relatively complex and expensive construction, usually involving a plurality of peripherally gated tumbler wheels operated from a single dial, a fence lever and fence bar pivoted to a slideable bolt member and controlled by the peripherally gated tumbler wheels and a specially shaped driving cam, and the tumbler wheels are usually of complex construction so as to prevent changing of the combination of the tumbler wheels. The present invention is concerned with a significantly simplified type of combination lock mechanism suitable for less costly locking applications, such as locking the zipper slide member of zipper type luggage cases, locking storage boxes with valuables and similar enclosures having a hasp and staple type of mechanism for securing the lid and the tray or body portion in closed position, and similar applications, wherein a plurality of dial members are adapted to be angularly positioned to set them to a combination of dial numbers and are associated with a movable fence mechanism and a reciprocative elongated bolt plate member or the like movable between relatively retracted and extended positions with respect to a lock housing.

An object of the present invention, therefore, is the provision of a novel combination lock construction applicable to a wide variety of installation conditions, which is relatively simple in construction and is particularly adapted for use on zipper type luggage receptacles and devices having a hasp and staple type of closure mechanism for securing relatively movable separable container sections in closed condition.

Another object of the present invention is the provision of a novel combination construction which can be relatively inexpensively manufactured and wherein a plurality of adjustable dial members are rotatably supported in side-by-side relation on a housing enclosing a fence plate movable back and forth in one direction radially of the dial members and co-active with a bolt plate reciprocatively movable between latching and unlatching position along an axis perpendicular to the axis of movement of the fence mechanism and having a coupling formation on one end thereof to be coupled to the item to be locked.

Another object of the present invention is the provision of a combination lock construction as described in the immediately preceding paragraph, wherein the coupling formation on the end of the bolt member is shaped to be exposed relative to the lock casing when the bolt member is in released position to couple and decouple the same with a zipper fastening loop, or is provided with means swingably supporting one leg of a shackle thereon to position the shackle at an outer release position when the bolt plate is in unlocking condition for coupling and decoupling the shackle relative to a hasp or similar co-operative structure.

Other objects, advantages and capabilities of the present invention will become apparent from the following detailed description, taken in conjunction with the accompanying drawings illustrating preferred embodiments of the invention.

BRIEF DESCRIPTION OF THE DRAWINGS

FIG. 1 is a fragmentary perspective view of a combination lock embodying the present invention adapted for use in locking the zipper slide member of zipper type fasteners for luggage and the like, shown in association with a zipper slide operating loop;

FIG. 2 is an exploded perspective view of the combination lock;

DETAILED DESCRIPTION OF PREFERRED EMBODIMENTS

Figure 3:
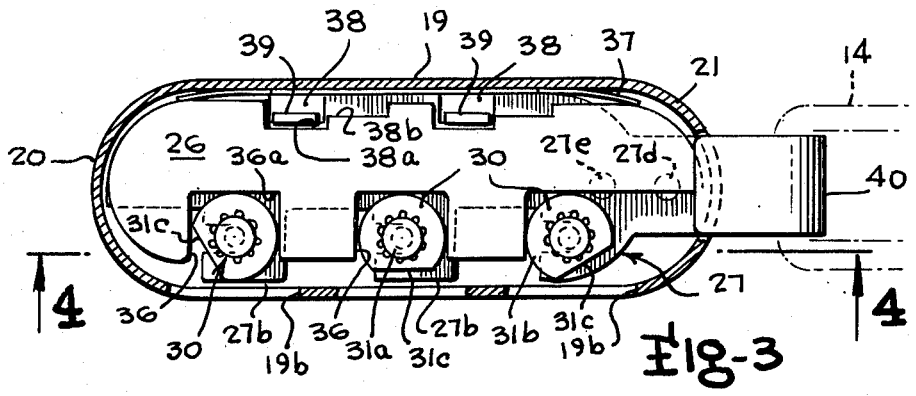
FIG. 3 is a front elevation view of the combination lock for zipper slide fasteners, with the front cover and dial wheels removed.

Referring to the drawings, wherein like reference characters designate corresponding parts throughout the several figures, and referring particularly to FIGS. 1 to 4, there is disclosed a combination lock, indicated generally by the reference character 10, for zipper type slide fasteners as indicated generally by the reference character 11, such as may be provided on zipper luggage 12. The zipper type slide fastener 11 has the conventional interlockable fastener elements which are positioned by a slider member or fastener operator 13 to interlock or disengaged condition. The slider member 13 of the zipper type slide fastener with which the combination lock of FIGS. 1 to 4 is to be used preferably has a closed loop type pull member 14 stamped from thin metal plate material or the like, which in the illustrated embodiment forms a substantially rectangular pull loop.

The combination lock 10 to be used with the zipper type slide fastener comprises a lock casing or housing 15 formed, for example, from a stamped cover section 16 and a mounting plate section 17, the cover section 16 having a front wall 18, side walls 19, and rounded end walls 20 and 21, the latter being apertured to provide a bolt opening 21*a*. Bendable lugs 19*a* may extend from the edges of the side walls 19 to extend through suitably located marginal recesses 22 in the lateral edge portions of the mounting plate 17 to be bent under the mounting plate for assembling the sections 16 and 17 together, and the mounting plate 17 may have fastening tabs 23 formed integrally with the cover plate and extending at right angles therefrom to extend through the wall of the luggage and be bent inwardly for retaining the lock housing 15 on the luggage.

With the chamber defined by the front cover section 16 and rear mounting plate section 17 of the housing 15, progressing from front to rear, are three side by side dial wheel assemblies 25*a*, 25*b*, 25*c*, located immediately inwardly of the front wall 18, behind which are a fence plate 26 and slidable bolt member 27. Each of the three dial assemblies 25*a*, 25*b*, and 25*c* are of similar construction and comprise an outer dial wheel 28 of annular cylindrical configuration having dial numbers on the cylindrical periphery thereof so as to be visible to the operator from one of the side walls 19 of the lock causing having the rectangular openings 19*b* therein through which a limited portion of the dial wheel projects. Each dial wheel 28 also has a plurality of shallow V-shaped grooves transversely spanning the dial wheel periphery in parallelism with the dial wheel axis and located between the successive numbers on the dial wheel periphery. Each dial wheel 28 has an axial bore 29 extending therethrough provided with a plurality of concave notches in the inwardly facing surface thereof, for example, 10 of such notches being provided in the illustrated example. Interfitted into the bore 29 of each dial wheel is a hub member 30 which includes a relatively smaller diameter, substantially cylindrical body portion 31*a* of a diameter corresponding to the minimum diameter of the bore 29 in the associated dial wheel 28 for relative rotation therein, and includes a larger diameter collar formation 31*b* of larger diameter than the minimum diameter of the bore 29 adapted to normally butt against the confronting face of the adjacent dial wheel 28. A plurality of eccentrically loated, axially elongated interlocking formations, shown in the illustrated embodiment as 10 centrifugally spaced, axially elongated pins of lugs 32 project axially from the collar formation 31*b* to be received in the notches in the inwardly facing surface of the bore 29 against relative angular movement at any of ten selected angular positions corresponding to the ten dial numbers on the periphery of the dial wheel 28. The relatively smaller diameter body portion 31*a* of the hub member 30 is of sufficient axial extent to project entirely through the axial bore 29 of the associated dial wheel 28 and extend therebeyond into one of the three journal sockets 33 in the front wall 18 of the cover section 16. The three journal sockets 33 in the front wall 18 are positioned to define the axes of rotation of the three dial assemblies, and are of appropriate depth so as to position the front faces of the three dial wheels 28 when located in normal fully coupled relation on the body portions 31*a* of their associated hubs 30 immediately inwardly of the inner surface of the front wall 18 with portions of the dial wheels projecting through the slots 19*b* in one of the side walls 19. The rearmost ends of the hub members 30 are provided with axially elongated rearwardly opening central sockets 34 in which are partially nested coil springs 35 which extend through cut-outs or recesses 27*a* in the lug formations 27*b* projecting laterally from the main body portion of the bolt member 27 and bear against the rear cover plate 17. The coil springs 35 resiliently bias the hub members into fully coupled relation in the bores of their associated dial wheels 28.

The collar formations 31*b* of the hub members 30 each have a flat or relieved portion 31*c* at a selected angular position along each of the collar formations, coacting with the fence plate 26 to permit such lateral movement of the fence plate 26 in a direction at right angles to the longitudinal axis of the bolt member 27 when the dial members are at the selected angular positions corresponding to the chosen combination to dispose the fence plate so as to release the bolt for sliding movement from retracted or locked position along an axis paralleling its longitudinal axis to a projected or release position.

Figure 4:
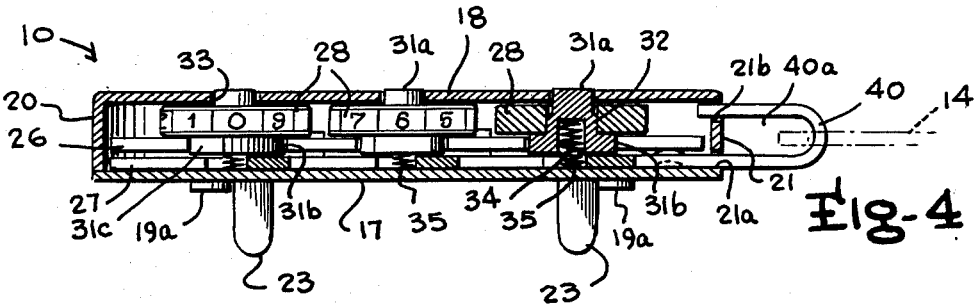
FIG. 4 is a vertical section view taken along the line 4—4 of FIG. 3.
Figure 5:
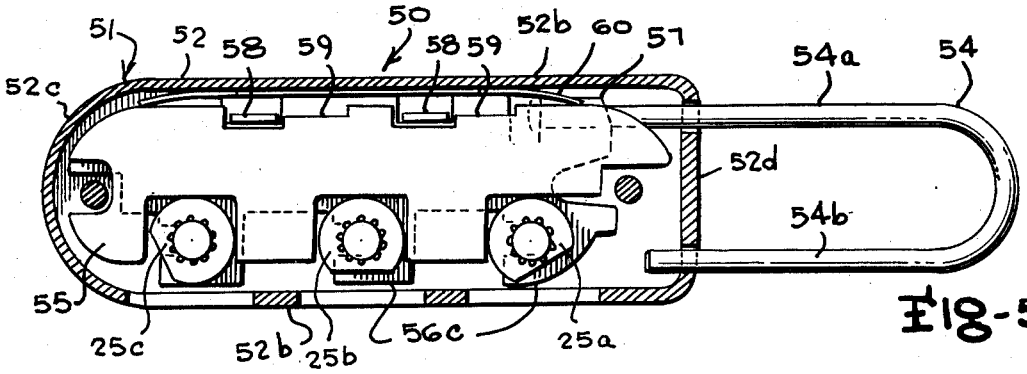
FIG. 5 is a front elevation view of a modified form of the combination lock adapted for use with a shackle with the front casing half and dial wheels removed.
Figure 6:
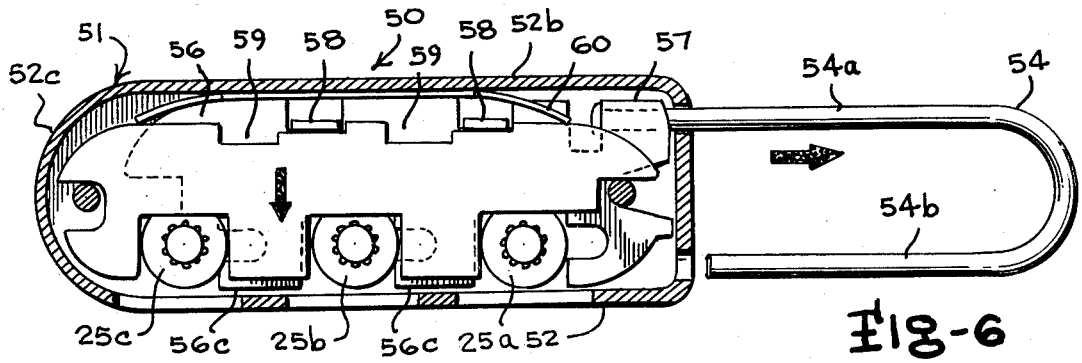
FIG. 6 is an elevation view of the combination lock shown in FIG. 5, with the front casing half and dial wheels removed and the locking mechanism shown in unlocking released position.
Figure 7:
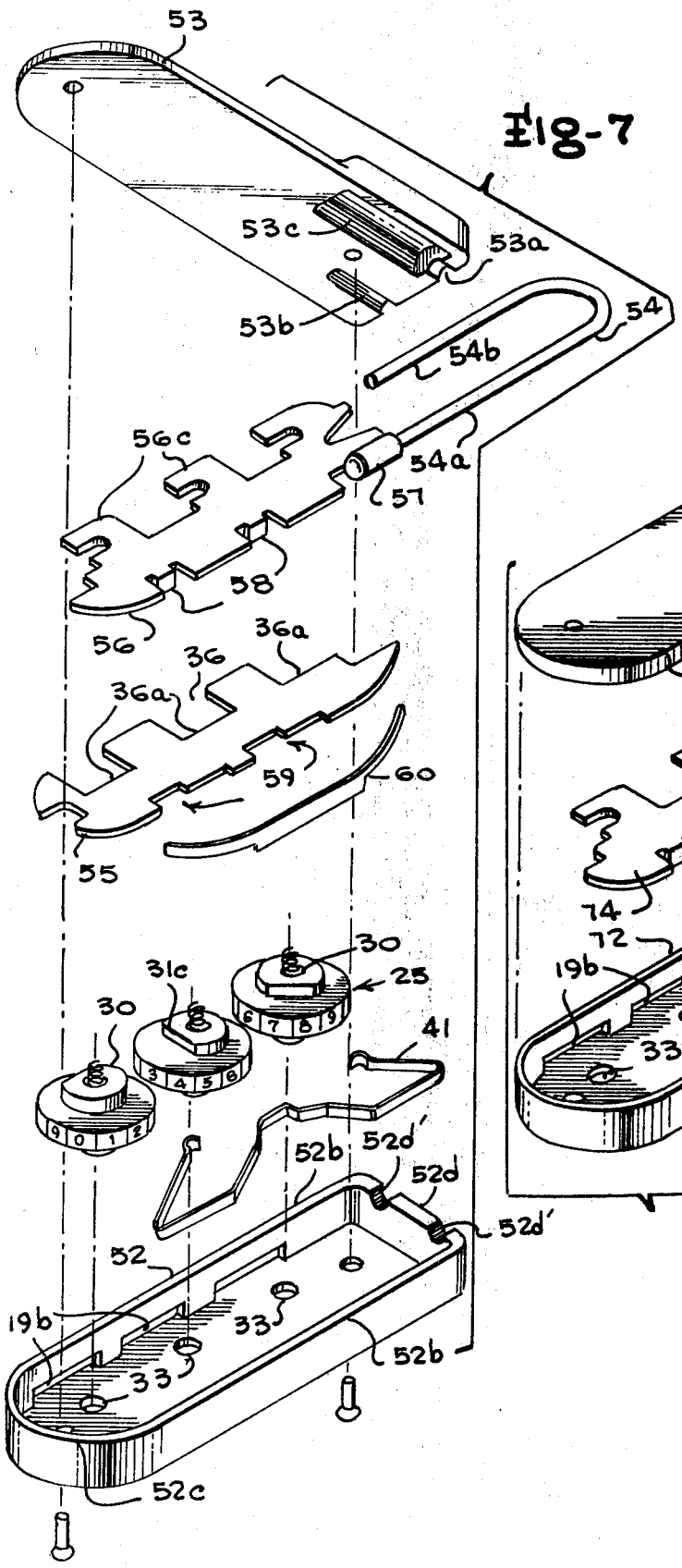
FIG. 7 is an exploded perspective view of the combination lock shown in FIG. 5.

The fence plate 26, as will be apparent from FIGS. 2 and 4, is an elongated relatively thin plate member having rounded opposite ends to nest in the cavity or chamber defined by the cover and mounting plate sections 16, 17, having a length approximating the length of the cavity and a width somewhat less than the width of the cavity for movement transverse to the longitudinal axis of the bolt member 27 between a normal locking position and a release position. The fence plate 26 has hub-accommodating recesses 36 along one edge thereof for accommodating the larger diameter collar formations 31*b* on the three hub members and including a straight hub contact surface 36*a* along a side of each of the recesses 36 paralleling the longitudinal axis of the bolt member 27 and bearing against the periphery of the enlarged collar formation 31*b* of the associated hub, causing the fence plate 26 to be positioned in the locking position when the contact surfaces 36*a* bear against the cylindrical portions of the collar peripheries and permitting the fence plate 26 to be moved by biasing spring 37 laterally relative to the longitudinal axis of the bolt member 27 and toward the hub centers when the flats 31*c* on the hub collars are positioned to exactly parallel to the contact surfaces 36*a*. The opposite lateral edge portions of the fence plate 26 have stepped recesses 38 therein comprising a deep recess portion 38*a* and a shallow recess portion 38*b* in each recess 38 to coact with forwardly turned locking lugs 39 on the corresponding edge portion of the bolt member 27.

When the fence plate 26 is held in the locking position by engagement of its contact surfaces 36*a* with the cylindrical portions of the peripheries of hub collars 31*b* against the force of fence biasing spring 37, the deeper recess portions 38*a* of the stepped recesses 38 register with and receive the locking lugs 39 of the bolt member 27 and restrain the latter in the retracted locked position. The bolt member 27 is loosely frictionally restrained in this position by registry of the detent nose formation 27*d* in the detent socket formation 17*a* of the mounting plate 17. The bolt member 27 is curved to define a hooked formation 40 on the end thereof projecting through the opening 21*a* in the housing end wall 21 which extends around the proximal transverse leg of the zipper slider pull loop 14 and terminates in a free end or lip 40*a* which may butt against the housing end wall 21 or may extend slightly into a slot or socket 21*b* provided in the housing end wall 21 in the illustrated embodiment. When the dial wheels and hubs of the dial assemblies 25*a*, 25*b* and 25*c* are angularly adjusted to the particular combination of the lock, the flats 31*c* on the hub collars 31*b* all face the contact surfaces 36*a* of the fence plate paralleling those surfaces and permit spring forced movement of the fence plate 26 toward the hub axes to the release position aligning the shallow recess portions 38*b* of the stepped recesses 38 with the locking lugs 39 along an axis paralleling the longitudinal axis of the bolt member 27 to accommodate sliding movement of the bolt member 27 along that longitudinal axis to the projected or release position wherein the detent nose 27*e* registers with the detent socket 17*a* and the hook formation 40 is located at a position spaced outwardly from the adjacent end wall 21 of the lock casing to permit the zipper pull loop 14 to be withdrawn from the hook formation 40 for manual operation of the zipper slide to open the zipper fastener. It will be noted that a specially shaped leaf spring member 41 is also provided in the interior chamber defined between the cover section 16 and mounting plate section 17 having end portions and a medial portion bearing against the peripheries of the dial wheels 28 to resiliently restrain them in the positions to which they are manually set.

The combination lock mechanisms illustrated in FIGS. 5 to 8 are similar in construction and concept to the zipper locking combination lock of FIGS. 1–4, with slight variations in the housing, the fence plate and the bolt member to adapt them to control a padlock shackle rather than to provide a hook formation for restraining a zipper pull loop. In the form shown in FIGS. 5, 6 and 7, the combination padlock 50 includes a casing or housing 51 formed of mating front and rear sections 52 and 53, the front section 52 defining a front wall 52*a* similar to front wall 18 bounded by side walls 52*b*, a curved bottom wall 52*c*, and a straight top end wall 52*d* provided with two socket portions 52*d'* to receive the two legs 54*a* and 54*b* of shackle 54. The rear casing section 53 has a substantially flat inner surface relieved by concave socket portions 53*a* and 53*b* mating with socket portions 53*d'* to receive the confronting portions of the shackle legs 54*a* and 54*b* and having an elongated cavity 53*c* therein to accommodate rectilinear movement of the end portion of the longer shackle leg 54*a* between retracted locked position wherein the end of the shorter shackle leg 54*b* is seated in the complementary socket portions therefor in the front and rear casing sections 52 and 53 and a projected release position wherein the end of the shorter shackle leg 54*b* is spaced outwardly from the adjacent end 52*d* of the casing front section 52 where the shackle is free to swing about the axis of its longer leg 54*a*.

Figure 8:
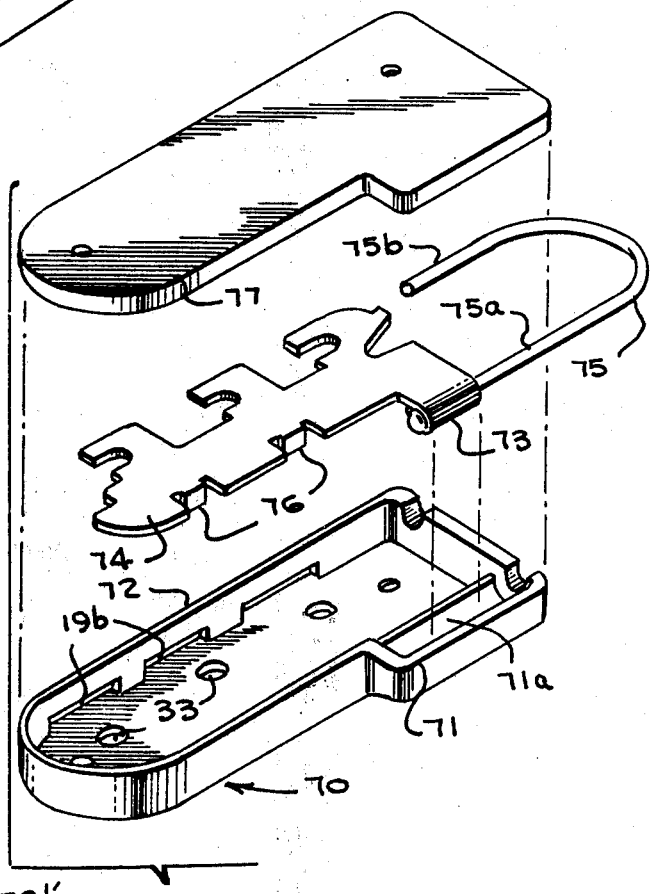
FIG. 8 is an exploded perspective view of a different form of slide bolt and shackle member assembly usable with the combination locking mechanism of FIGS. 5 to 7.

Dial assemblies 25*a*, 25*b* and 25*c* identical to those employed in the first described embodiment are provided in the mechanism chamber defined by the front and rear casing sections 52 and 53, as well as a spring biased fence plate 55 shaped almost exactly like the fence plate 26 and a longitudinally movable, elongated bolt member 56 shaped similar to the bolt member 27 but having a curved sleeve formation 57 extending about the end portion of the longer shackle leg 54*a* to intercouple the bolt member 56 with the shackle and permit relative rotation of the shackle about the axis of its longer leg. The bolt member 56 has recessed lug formations 56*a* like the lug formations 27*b* and has locking lugs 58 corresponding to the locking lugs 39 cooperating with stepped recesses 59 of the fence plate 55 which are like the stepped recesses 38 of the fence plate 26 in the previously described embodiment. Fence biasing leaf spring 60, like the previously described spring 37, and dial wheel detenting spring 61 like the spring 41, are also provided in the mechanism chamber defined by the padlock casing. A still further embodiment is illustrated in FIG. 8, indicted by the reference character 70, which differs from the padlock 50 of FIGS. 5–7 only in providing an offset formation 71 on the casing front section 72 having an internal elongated cavity 71*a* for accommodating the sleeve formation 73 of bolt member 74 extending around and journalling the longer leg 75*a* of shackle 75 and accommodating movement of the shackle between retracted and extended positions. The shackle 75 has a somewhat greater spacing between its longer leg 75*a* and its shorter leg 75*b*, and the sleeve formation 73 of the bolt member 74 is offset laterally somewhat from the edge of the bolt member 74 having the locking lugs 76 thereon. In other respects, the combination padlock 70 of FIG. 8 is like the combination padlock of FIGS. 5–7 and includes the same fence plate, dial assembly and spring members. The rear casing section 77 has a perimeter shaped to conform to the front casing section 72 to mate therewith and has shackle socket formations registering with the shackle socket formations on the front casing section to provide openings for the shackle legs 75*a* and 75*b*.

In both the modified embodiments of FIGS. 5–7 and 8, the combination is manually dialed by engaging the peripheral portions of the dial wheels projecting through slots in one of the side walls of the front casing section 52 or 72 to position the flats 31*c* of the dial hub collars 31*b* in alignment and facing the contact surfaces 36*a* of the fence plate 55, whereupon the fence plate 55 is spring forced toward the hub axes to align the shallow recess portions of the recesses 59 with the locking lugs 58 or 76 along the slide axis of the associated bolt member 56 or 74. When the fence plate 55 is in this release position, the shackle 54 or 75 can be grasped by the operator and pulled outwardly through a range of movement corresponding to the length of the shallow recess portions which is adequate to permit withdrawal of the end of the shorter shackle leg 54*b* or 75*b* from the lock casing permitting rotation of the shackle to an open condition about the axis of its longer leg. To return the padlock to locked condition, the shackle is manually pushed inwardly to the retracted position relative to the padlock casing when the shorter shackle leg is aligned with its associated socket, thereby returning the fence plate intercoupled with the shackle to a position aligning its locking lugs 58 or 76 laterally with the deeper recess portions of the stepped recesses of the associated fence plate 55, whereupon the dial assemblies can be rotated to scramble their positions and thereby force the fence plate laterally to its locking position.

What is claimed is:

1. A combination lock assembly for securing a closure member and the like, comprising an elongated lock housing extending along a reference plane and having front and rear wall members and opposite end walls defining a mechanism chamber therebetween, a combination lock mechanism housed in said mechanism chamber including an elongated bolt plate member adjacent said rear wall and an elongated fence plate and a plurality of dial assemblies located generally in three planes paralleling said reference plane progressing forwardly from said rear wall member, the bolt plate member having a locking formation at one end thereof and being supported for reciprocative movement longitudinally along a rectilinear first axis paralleling said reference plane between a locked position and a release position disposing said locking formation in retracted and extended positions respectively relative to the lock housing, the plurality of rotatable dial assemblies being supported in side by side relation for rotation about axes perpendicular to said reference plane and each comprising an annular wheel member supported inwardly adjacent the front wall of said housing having a portion projecting to an externally exposed position for manipulation to angular positions forming a selected dial combination and each including a hub member coupled with the wheel member for rotation with the latter, said fence plate being located between said bolt plate and said dial assemblies supported for translatory movement in a plane paralleling said reference plane along an axis normal to said first axis, said fence plate and dial wheel hub members having coactive shaped surfaces for restraining the fence plate at a locking position when the dial wheel members are displaced from the selected combination and shaped to accommodate translatory movement of the fence plate perpendicular to said first axis to release position when the dial wheel members occupy said selected combination, spring means bearing against said fence plate for continuously resiliently biasing the same to said release position, said bolt plate member having rigid forwardly projecting locking lug formations thereon projecting through the plane of said fence plate, and said fence plate having recess means defining shoulder surfaces positioned to restrain the bolt plate against movement from its locking position when the fence plate is in locking position and having recess portions laterally alined with said locking lug formations along the direction of said first axis to be positioned to receive the associated locking lug when said fence plate assumes said release position and accommodate relative movement of the associated locking lug into the recess portions and permit movement of the bolt plate member to said release position.

2. A combination lock assembly as defined in claim 1, wherein said recess means comprises a stepped recess formation associated with each locking lug formation including a first deeper recess having a width corresponding to the locking lug width for receiving the associated locking lug in nested relation therein when the fence plate is in said locking position, the deeper recess having bounding surfaces laterally flanking the associated locking lug for preventing movement of the locking lugs and bolt plate member longitudinally from said locking position, and said stepped recesses each including a shallow recess portion laterally communicating with the deeper recess portion of each stepped recess formation forming the recess portion for receiving the associated locking lug when the fence plate assumes the release position.

3. A combination lock assembly as defined in claim 1, wherein each of said hubs have a cylindrical portion interrupted by a flat formation thereon adjacent said fence member, said fence member having recesses therein receiving the respective hubs of said dial assemblies for rotation therein and each having a flat fence surface facing the respective hub, and said hub cylindrical portions normally maintaining the fence member in locking position and said flat formations permitting movement of the fence member to release position when the wheel assemblies are adjusted to the angular positions of the lock combination disposing said flat formations in parallel confronting relation with said flat fence surfaces.

4. A combination lock assembly as defined in claim 1, wherein said dial wheel assemblies are disposed in side by side relation for angular movement about parallel axes of rotation perpendicular to said reference plane, each dial wheel assembly comprising said annular wheel member having a central bore and an indicia bearing periphery and said hub member associated therewith being slidably and rotatably journalled for movement relative to the associated annular wheel member and extending entirely through the bore thereof, said hubs having cylindrical end portions releasably coupled in the bore of the annular wheel member associated therewith having a circumferential portion coacting with said fence plate to restrain the latter in locking position and having a flat at a selected angular position for admitting movement of said fence plate to said release position.

5. A combination lock assembly as defined in claim 1, wherein said annular wheel members of said dial wheel assemblies each have a center opening having a plurality of circumferentially spaced recesses in the surface of the opening, and each of said hub portions having projections at a location thereon to interfit in said recesses of the annular wheel member at any of a plurality of different angular positions relative to the associated wheel member for establishing the combination of the lock assembly.

6. A combination lock assembly as defined in claim 4, wherein said annular wheel members of said dial wheel assemblies each have a center opening having a plurality of circumferentially spaces recesses in the surface of the opening, and each of said hub portions having projections at a location thereon to interfit in said recesses of the annular wheel member at any of a plurality of different angular positions relative to the associated wheel member for establishing the combination of the lock assembly.

7. A combination lock assembly as defined in claim 1, for locking against movement the zipper slider of a zipper type fastener having a closed loop type pull loop pivoted thereon, the lock casing being fixed relative to a wall adjacent a portion of the slide fastener, and said locking formation on one end of said bolt plate member comprising a recurved hook formation extending from one end wall of the lock housing adapted to extend about a leg of the pull loop when the slider is positioned at one end of the zipper fastener with the zipper fastener in closed condition, the hook formation having a free end portion which is spaced sufficiently far from the adjacent end wall of the lock housing when the bolt plate member is in extended position to permit passage of the pull loop leg therebetween and being located closely adjacent said adjacent end wall of the lock housing when the bolt plate member is in said retracted position preventing decoupling of the pull loop leg from said hook formation.

8. A combination lock assembly as defined in claim 7, wherein the end wall of the lock housing adjacent said hook formation has an outwardly opening recess therein facing the free end portion of said hook formation, and said free end formation being located in nested relation in said outwardly opening recess when the bolt plate member occupies said retracted position.

9. A combination lock assembly as defined in claim 2, for locking against movement the zipper slider of a zipper type fastener having a closed loop type pull loop pivoted thereon, the lock casing being fixed relative to a wall adjacent a portion of the slide fastener, and said locking formation on one end of said bolt plate member comprising a recurved hook formation extending from one end wall of the lock housing adapted to extend about a leg of the pull loop when the slider is positioned at one end of the zipper fastener with the zipper fastener in closed condition, the hook formation having a free end portion which is spaced sufficiently far from the adjacent end wall of the lock housing when the bolt plate member is in extended position to permit passage of the pull loop leg therebetween and being located closely adjacent said adjacent end wall of the lock housing when the bolt plate member is in said retracted position preventing decoupling of the pull loop leg from said hook formation.

10. A combination lock assembly as defined in claim 4, for locking against movement the zipper slider of a zipper type fastener having a closed loop type pull loop pivoted thereon, the lock casing being fixed relative to a wall adjacent a portion of the slide fastener, and said locking formation on one end of said bolt plate member comprising a recurved hook formation extending from one end wall of the lock housing adapted to extend about a leg of the pull loop when the slider is positioned at one end of the zipper fastener with the zipper fastener in closed condition, the hook formation having a free end portion which is spaced sufficiently far from the adjacent end wall of the lock housing when the bolt plate member is in extended position to permit passage of the pull loop leg therebetween and being located closely adjacent said adjacent end wall of the lock housing when the bolt plate member is in said retracted position preventing decoupling of the pull loop leg from said hook formation.

11. A combination lock assembly as defined in claim 4, for locking against movement the zipper slider of a zipper type fastener having a closed loop type pull loop pivoted thereon, the lock casing being fixed relative to a wall adjacent a portion of the slide fastener, and said locking formation on one end of said bolt plate member comprising a recurved hook formation extending from one end wall of the lock housing adapted to extend about a leg of the pull loop when the slider is positioned at one end of the zipper fastener with the zipper fastener in closed condition, the hook formation having a free end portion which is spaced sufficiently far from the adjacent end wall of the lock housing when the bolt plate member is in extended position to permit passage of the pull loop leg therebetween and being located closely adjacent said adjacent end wall of the lock housing when the bolt plate member is in said retracted position preventing decoupling of the pull loop leg from said hook formation, the end wall of the lock housing adjacent said hook formation having an outwardly opening recess therein facing the free end portion of said hook formation, and said free end formation being located in nested relation in said outwardly opening recess when the bolt plate member occupies said retracted position.

12. A combination lock assembly as defined in claim 6, for locking against movement the zipper slider of a zipper type fastener having a closed loop type pull loop pivoted thereon, the lock casing being fixed relative to a wall adjacent a portion of the slide fastener, and said locking formation on one end of said bolt plate member comprising a recurved hook formation extending from one end wall of the lock housing adapted to extend about a leg of the pull loop when the slider is positioned at one end of the zipper fastener with the zipper fastener in closed condition, the hook formation having a free end portion which is spaced sufficiently far from the adjacent end wall of the lock housing when the bolt plate member is in extended position to permit passage of the pull loop leg therebetween and being located closely adjacent said adjacent end wall of the lock housing when the bolt plate member is in said retracted position preventing decoupling of the pull loop leg from said hook formation, the end wall of the lock housing adjacent said hook formation having an outwardly opening recess therein facing the free end portion of said hook formation, and said free end formation being located in nested relation in said outwardly opening recess when the bolt plate member occupies said retracted position.

13. A combination lock assembly as defined in claim 1, for use as an exposed shackle padlock, wherein said locking formation at one end of said bolt plate member comprises a U-shaped shackle member having a longer shackle leg and a shorter shackle leg, the bolt plate member having a curved sleeve formation providing an encircling journal connection for an end portion of the longer shackle leg permitting swinging movement of the shackle about the axis of its longer leg, said lock housing having a pair of openings in one of the end walls providing sockets for said shackle legs, and said shorter shackle leg being located in outwardly spaced relation from the lock housing when the bolt plate member occupies said extended position freeing the shackle for swinging movement about the axis of the longer shackle leg and being nested in the socket therefor in said last-mentioned end wall when said bolt plate member occupies said retracted position.

14. A combination lock assembly as defined in claim 2, for use as an exposed shackle padlock, wherein said locking formation at one end of said bolt plate member comprises a U-shaped shackle member having a longer shackle leg and a shorter shackle leg, the bolt plate member having a curved sleeve formation providing an encircling journal connection for an end portion of the longer shackle leg permitting swinging movement of the shackle about the axis of its longer leg, said lock housing having a pair of openings in one of the end walls providing sockets for said shackle legs, and said shorter shackle leg being located in outwardly spaced relation from the lock housing when the bolt plate member occupies said extended position freeing the shackle for swinging movement about the axis of the longer shackle leg and being nested in the socket therefor in said last-mentioned end wall when said bolt plate member occupies said retracted position.

15. A combination lock assembly as defined in claim 4, for use as an exposed shackle padlock, wherein said locking formation at one end of said bolt plate member comprises a U-shaped shackle member having a longer shackle leg and a shorter shackle leg, the bolt plate member having a curved sleeve formation providing an encircling journal connection for an end portion of the longer shackle leg permitting swinging movement of the shackle about the axis of its longer leg, said lock housing having a pair of openings in one of the end walls providing sockets for said shackle legs, and said shorter shackle leg being located in outwardly spaced relation from the lock housing when the bolt plate member occupies said extended position freeing the shackle for swinging movement about the axis of the longer shackle leg and being nested in the socket therefor in said last-mentioned end wall when said bolt plate member occupies said retracted position.

16. A combination lock assembly as defined in claim 6, for use as an exposed shackle padlock, wherein said locking formation at one end of said bolt plate member comprises a U-shaped shackle member having a longer shackle leg and a shorter shackle leg, the bolt plate member having a curved sleeve formation providing an encircling journal connection for an end portion of the longer shackle leg permitting swinging movement of the shackle about the axis of its longer leg, said lock housing having a pair of openings in one of the end walls providing sockets for said shackle legs, and said shorter shackle leg being located in outwardly spaced relation from the lock housing when the bolt plate member occupies said extended position freeing the shackle for swinging movement about the axis of the longer shackle leg and being nested in the socket therefor in said last-mentioned end wall when said bolt plate member occupies said retracted position.

* * * * *